United States Patent [19]

Uchida

[11] Patent Number: 4,959,632

[45] Date of Patent: Sep. 25, 1990

[54] ORGANIC PTC THERMISTOR

[75] Inventor: Katsuyuki Uchida, Kagaokakyo, Japan

[73] Assignee: Murata Manufacturing Co., Ltd., Japan

[21] Appl. No.: 334,213

[22] Filed: Apr. 6, 1989

[30] Foreign Application Priority Data

Apr. 6, 1988 [JP] Japan ..... 63-85864

[51] Int. Cl.[5] ..... H01C 7/00

[52] U.S. Cl. ..... 338/22 R; 29/612; 338/309; 338/324; 338/327; 338/328; 338/332

[58] Field of Search ..... 338/307–309, 338/314, 22 R, 22 SD, 322, 324, 327, 328, 332, 333, 334; 26/610.1, 612, 619, 621; 427/161, 102, 103, 275; 219/541, 505

[56] References Cited

U.S. PATENT DOCUMENTS

| | | | |
|---|---|---|---|
| 3,503,029 | 3/1970 | Matsuoka | 338/22 R X |
| 4,327,351 | 4/1982 | Walker | 338/328 X |
| 4,833,305 | 5/1985 | Mashimo et al. | 338/22 R X |

*Primary Examiner*—C. L. Albritton

*Attorney, Agent, or Firm*—Ostrolenk, Faber, Gerb & Soffen

[57] ABSTRACT

An organic positive temperature coefficient (PTC) thermistor includes an organic PTC thermistor sheet on which a roughened surface is formed by pressing a wire mesh against one main surface thereof at a predetermined pressure. This results in the main surface of the organic PTC thermistor sheet being roughtened. A pair of electrodes are then formed on the main surface of the organic PTC thermistor sheet.

6 Claims, 2 Drawing Sheets

ORGANIC PTC THERMISTOR

BACKGROUND OF THE INVENTION

1. Field of the invention

The present invention relates to an organic positive temperature coefficient (PTC) thermistor. More specifically, the present invention relates to an organic PTC thermistor in which an electrode made from conductive paste is formed on a main surface of an organic PTC thermistor sheet.

2. Description of the Background art

An organic resin which the nature of a PTC thermistor is obtained by mixing and distributing conductive particles such as carbon black, graphite, metallic powder or the like in a polyolefin-family resin, such as polyethylene. It is known that an organic PTC thermistor is obtained by forming such an organic PTC thermistor resin as an organic PTC thermistor sheet and by forming a pair of electrodes on a main surface thereof.

In order to form a pair of electrodes in such an organic PTC thermistor, there exist a method wherein metallic foil is adhered on the main surface of the organic PTC thermistor sheet and the electrodes having a predetermined pattern are formed by etching the metallic foil, and a method wherein electrodes having a predetermined pattern are formed on the main surface of the organic PTC thermistor sheet by screenprinting conductive paste thereon.

In an etching method, there the possibility that the organic PTC thermistor sheet is deteriorated by an etching solution. In view of this point, a method where the electrodes are formed by the conductive paste is superior to the etching method.

However, in the method where the; electrodes are formed by conductive paste the following problem occurs the following takes place. Specifically, the organic PTC thermistor sheet is normally obtained by extrusion molding or press molding of the organic PTC thermistor resin. In molding, lack of uniformity of distribution of the conductive particles takes place in the organic PTC thermistor sheet such that the density of conductive particles at the surface of the organic PTC thermistor sheet (i.e. surface density) is lowered. Therefore, in the case where the electrodes are formed by painting or printing the conductive paste on the surface of such an organic PTC thermistor sheet as it is, a resistance value between the electrodes of the organic PTC thermistor becomes very large in comparison with the inherent resistance constant of the organic PTC thermistor sheet, and there results a large dispersion of the resistance value due to dispersion of the surface density of the conductive particles at the surface of the organic PTC thermistor sheet. Therefore, in the case where the organic PTC thermistor is used as a heating plate, heating temperature cannot become even in the whole surface of the organic PTC thermistor sheet.

SUMMARY OF THE INVENTION

Therefore, a principal object of the present invention is to provide a novel organic PTC thermistor.

Another object of the present invention is to provide an organic PTC thermistor in which an electrode can be contacted with an organic PTC thermistor sheet in a relatively deep surface region of the organic PTC thermistor sheet.

A further object of the present invention is to provide an organic PTC thermistor in which a surface of an organic PTC thermistor sheet is roughened by a mechanical method and an electrode is formed on a roughened surface.

An organic PTC thermistor in accordance with the present invention comprises an organic PTC thermistor sheet a surface which is roughened by a mechanical method; and a pair of electrodes formed on a roughened surface of the organic PTC thermistor sheet by painting or printing conductive paste.

On the surface of the organic PTC thermistor sheet, unevenness is formed by a mechanical method, and therefore, in microscopically viewing a surface layer of the organic PTC thermistor sheet, the conductive particles can be distributed at constant density in at least recess portions in the surface layer. On the other hand, when the conductive paste is painted or printed on the roughened surface of the organic PTC thermistor sheet, the conductive paste enters in the recess portions. Therefore, the electrode made from the conductive paste contacts with the organic PTC thermistor sheet in the relatively deep surface portion of the organic PTC thermistor sheet wherein distribution density of the conductive particles is substantially uniform or even.

Therefore, in accordance with the present invention, dispersion of a resistance value between the electrodes becomes small and it is possible to uniformly generate heat in the whole surface of the organic PTC thermistor sheet. Furthermore, since the surface of the organic PTC thermistor sheet is roughened, adhesion strength between the electrodes made from the conductive paste and the organic PTC thermistor sheet is increased so that reliability can be increased.

The objects and other objects, features, aspects and advantages of the present invention will become more apparent from the following detailed description of the embodiments of the present invention when taken in conjunction with accompanying drawings.

DETAIL DESCRIPTION OF THE PREFERRED EMBODIMENTS

Figure 1:
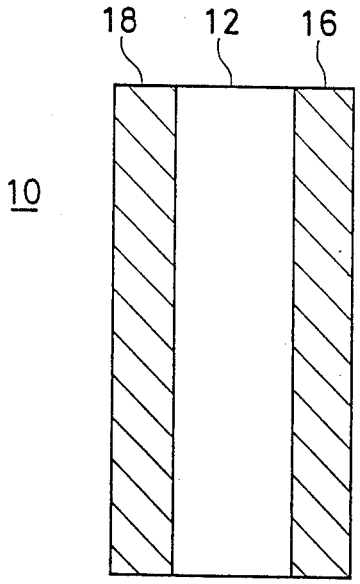
FIG. 1 is a top plan view showing one embodiment in accordance with the present invention.
Figure 2:
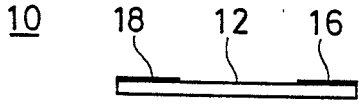
FIG. 2 is an illustrative view showing a crosssection of FIG. 1 embodiment.
Figure 3:
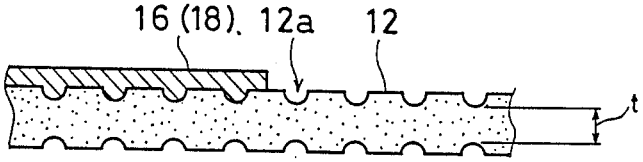
FIG. 3 is an illustrative sectional review showing an enlarged major portion of FIG. 2.
Figure 4:
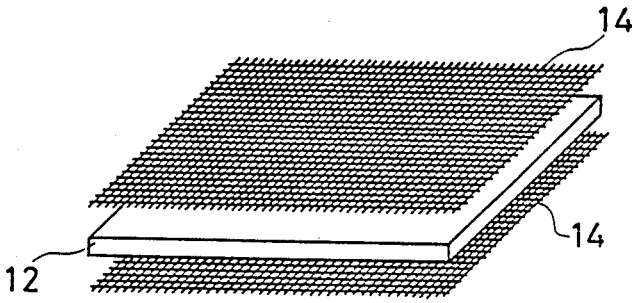
FIG. 4 is an illustrative view showing one example of a method for forming unevenness on a surface of an organic PTC thermistor sheet.

With reference to FIG. 1 and FIG. 2, an organic thermistor 10 of this embodiment includes an organic PTC thermistor sheet 12 made of a PTC thermistor resin in which conductive particles such as carbon black, graphite, or powder are mixed and distributed in a polyolefin family resin. As shown in FIG. 3, very small recess portions **12*a* are formed on both surfaces of the organic PTC thermistor sheet 12 throughout the whole surface. Such recess portions 12*a* can be formed by pressing a stainless steel wire mesh 14 against the both surfaces of the organic PTC thermistor sheet 12 at a predetermined pressure, as shown in FIG. 4**.

Then, on the surface of the organic PTC thermistor sheet 12 where a number of recess portions 12*a* are thus formed, as shown in FIG. 1 and FIG. 2, a pair of electrodes 16 and 18 are formed. These electrodes 16 and 18 can be formed by painting or printing conductive paste such as silver, paste.

In an experiment, organic PTC thermistor material in which conductive particles are mixed and distributed in the polyolefin-family resin is pressed at 190° C. and 120 kg/cm$^2$ for 10 minutes to form an organic PTC thermistor sheet of 200×200 mm and thickness of 0.5 mm. Then, in accordance with the method as shown in FIG. 4, a stainless wire mesh having a predetermined mesh size is pressed against the both surfaces of the organic PTC thermistor sheet at the normal temperature and 120 kg/cm$^2$ for 3 minutes to form a number of recess portions 12*a* as shown in FIG. 3.

Thereafter, the organic PTC thermistor sheet is cut into 10×20 mm portion and silver paste is painted with interval of 5 mm. Then, the silver paste is dried at 40° C. for 30 minutes so as to form the electrodes 16 and 18 as shown in FIG. 1 and FIG. 2.

Thus, embodiment samples, 1–4 comparative samples 1–3 each including 10 samples are manufactured. In the embodiment samples 1, mesh size of the stainless steel wire mesh is 40 mesh/inch, and 60 mesh/inch is utilized in the embodiment samples 2, 100 mesh/inch is utilized in the embodiment samples 3, and 200 mesh/inch is utilized in the embodiment samples 4. In addition, in the comparative sample 1, the organic PTC thermistor sheet which has a surface not roughened is utilized as it is. In the comparative samples 2, a wire mesh of 250 mesh/inch is utilized, and a wire mesh of 25 mesh/inch is utilized in the comparative samples 3.

A resistance value between the electrodes 16 and 18 (FIG. 1) and "3CV" are measured with respect to each sample. A result of such measurement is indicated in the following table. In addition, the term "3CV" means a value obtained by dividing dispersion of the resistance values by an average value.

TABLE

| | mesh/inch | resistance value (ohms) | 3CV(%) |
|---|---|---|---|
| Embodiment Samples 1 | 40 | 131.3–193.6 | 35.2 |
| Embodiment Samples 2 | 60 | 100.3–149.6 | 29.4 |
| Embodiment Samples 3 | 100 | 65.3–93.2 | 25.3 |
| Embodiment Samples 4 | 200 | 51.2–70.1 | 25.6 |
| Comparative Samples 1 | not used | 50.1–352.5 | 232.5 |
| Comparative Samples 2 | 250 | 50.3–203.3 | 158.3 |
| Comparative Samples 3 | 25 | — | — |

As seen from the above table, in the embodiment samples in accordance with the present invention, in comparison with the comparative samples, the dispersion (3CV) of the resistance values becomes very small. More specifically, in the comparative samples 1, the dispersion of the resistance values reflects the dispersion of the surface density of the conductive particles at the surface of the organic PTC thermistor sheet, as similar to the conventional example. In the comparative samples 2, since the mesh size of the wire mesh is too small, depth of the recess portions 12*a* as shown in FIG. 3 becomes shallow, and therefore, due to influence of the distribution density of the conductive particles, the dispersion of the resistance values becomes large. In addition, in the comparative samples 3, since the mesh size is too large, depth of the recess portions 12*a* (FIG. 3) becomes deep and holes which approximately penetrate the organic PTC thermistor sheet are formed, and thus, it was impossible to form the electrodes by painting or printing the silver paste.

In addition, in the embodiment samples 1–4, the larger the mesh size of the wire mesh, the larger the resistance value. A reason for such result is that the larger the mesh size of the wire mesh, the deeper the depth of the recess portions 12*a*, and therefore, substantive thickness (shown by "t" in FIG. 3) of the organic PTC thermistor sheet 12 becomes thin.

As described above, in accordance with the embodiment, in order to roughen the surface of the organic PTC thermistor sheet, a method where recess portions are formed by pressing a wire mesh is utilized rather than a chemical etching method, and therefore, deterioration of the organic PTC thermistor sheet itself by a solution or acid utilized in chemical etching does not take place.

Figure 5:
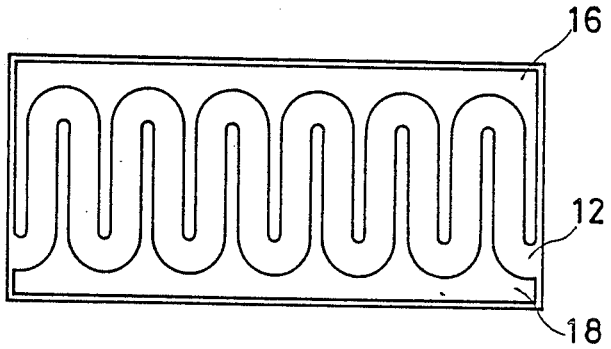
FIG. 5 is a top plan view showing another example of an electrode pattern.

In addition, the size of each sample of the organic PTC thermistor sheet indicated in the table is relatively, small as such 20×15 mm. However, in the case where the same is used as a heating plate in practice, the organic PTC thermistor sheet having a larger area is utilized. In this case, on the surface of the organic PTC thermistor sheet 12, as shown in FIG. 5, a pair of electrodes 16 and 18 each having a comb-shape are formed. However, a practical electrode pattern cannot be limited to the one of the embodiment, and may be arbitrary.

Figure 6:
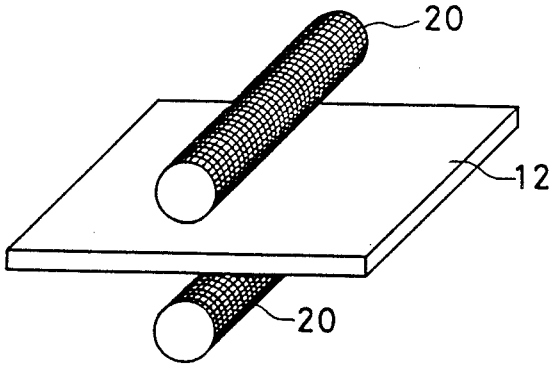
FIG. 6 is an illustrative view showing another example of a method for forming unevenness on a surface of an organic PTC thermistor sheet.

FIG. 6 is an illustrative view showing another method for forming unevenness on a surface of the organic PTC thermistor sheet. In the FIG. 6 embodiment, instead of the stainless steel wire mesh 14 of FIG. 4 embodiment, rollers 20 are utilized. On a surface of each roller 20, mesh-like unevenness which is similar to the stainless steel wire mesh 14 of the FIG. 4 embodiment is formed. By pressing the organic PTC thermistor sheet 12 by means of such rollers 20, it is possible to form a number of very small recess portions 12*a* as shown in FIG. 3.

Although the present invention has been described and illustrated in detail, it is clearly understood that the same is by way of illustration and example only and is not to be taken by way of limitation; the spirit and scope of the present invention being limited only by the terms of the appended claims.

What is claimed is:

1. An organic PTC thermistor, comprising:

an organic PTC thermistor sheet, a surface of said organic PTC thermistor sheet being roughened by a mechanical method; and a pair of electrodes formed on a thus roughened surface of said organic PTC thermistor sheet by means of conductive paste.

2. An organic PTC thermistor in accordance with claim 1, wherein a number of recess portions are formed on the surface of said organic PTC thermistor sheet by pressing an uneven member.

3. An organic PTC thermistor in accordance with claim 2, wherein said uneven member includes a wire mesh.

4. An organic PTC thermistor in accordance with claim 2, wherein said uneven member includes a roller on a surface of which unevenness is formed.

5. A method for roughening a surface of an organic PTC thermistor sheet, comprising a step of pressing an uneven member against the surface of said organic PTC thermistor sheet at a predetermined pressure.

6. A method for manufacturing an organic PTC thermistor, comprising steps of:

preparing an organic PTC thermistor sheet;

roughening a surface of said organic PTC thermistor sheet by a mechanical method; and forming a pair of electrodes on a roughened surface of said organic PTC thermistor sheet by painting or printing conductive paste.

* * * * *